US006510671B2

(12) United States Patent
Focke et al.

(10) Patent No.: US 6,510,671 B2
(45) Date of Patent: Jan. 28, 2003

(54) APPARATUS FOR PRODUCING BUNDLE PACKAGES FOR CIGARETTES

(75) Inventors: Heinz Focke, Verden (DE); Reinhard Lohmann, Scheessel (DE)

(73) Assignee: Focke & Co. (GmbH & Co.), Verden (DE)

( * ) Notice: Subject to any disclaimer, the term of this patent is extended or adjusted under 35 U.S.C. 154(b) by 65 days.

(21) Appl. No.: 09/752,460

(22) Filed: Jan. 3, 2001

(65) Prior Publication Data

US 2002/0050118 A1 May 2, 2002

(30) Foreign Application Priority Data

Jan. 11, 2000 (DE) ..... 100 00 798

(51) Int. Cl.[7] ..... B65B 11/28

(52) U.S. Cl. ..... 53/234; 53/228; 53/230; 493/437; 493/457

(58) Field of Search ..... 53/234, 228, 230, 53/466; 493/437, 457, 444

(56) References Cited

U.S. PATENT DOCUMENTS 3,810,314 A * 5/1974 Anderson ..... 53/230
4,430,842 A * 2/1984 Focke ..... 53/228
4,509,310 A * 4/1985 Focke et al. ..... 53/234
4,711,065 A * 12/1987 Focke et al. ..... 53/234
6,035,612 A * 3/2000 Draghetti et al. ..... 53/234

FOREIGN PATENT DOCUMENTS

| | | |
|---|---|---|
| DE | 2361545 | 11/1974 |
| DE | 24 48 122 | 5/1975 |
| DE | 195 29 798 | 3/1996 |
| DE | 195 21 476 | 12/1996 |
| FR | 2 346 223 | 10/1977 |

* cited by examiner

*Primary Examiner*—Rinaldi I. Rada
*Assistant Examiner*—Thanh Truong
(74) *Attorney, Agent, or Firm*—Sughrue Mion, PLLC

(57) ABSTRACT

During the production of cuboid-shaped packages, in particular bundle packages made of thin cardboard, it is necessary to form sharp-edged package edges (44, 45), namely those having a right-angled cross-section. This is ensured by means of a folding aid, namely by edge supports (40, 41), around which the folding flaps (27, 28) are folded to form the package edges (44, 45). The edge supports (40, 41) are retracted from their supporting position after folding is completed and the package is finished.

8 Claims, 3 Drawing Sheets

Fig.2
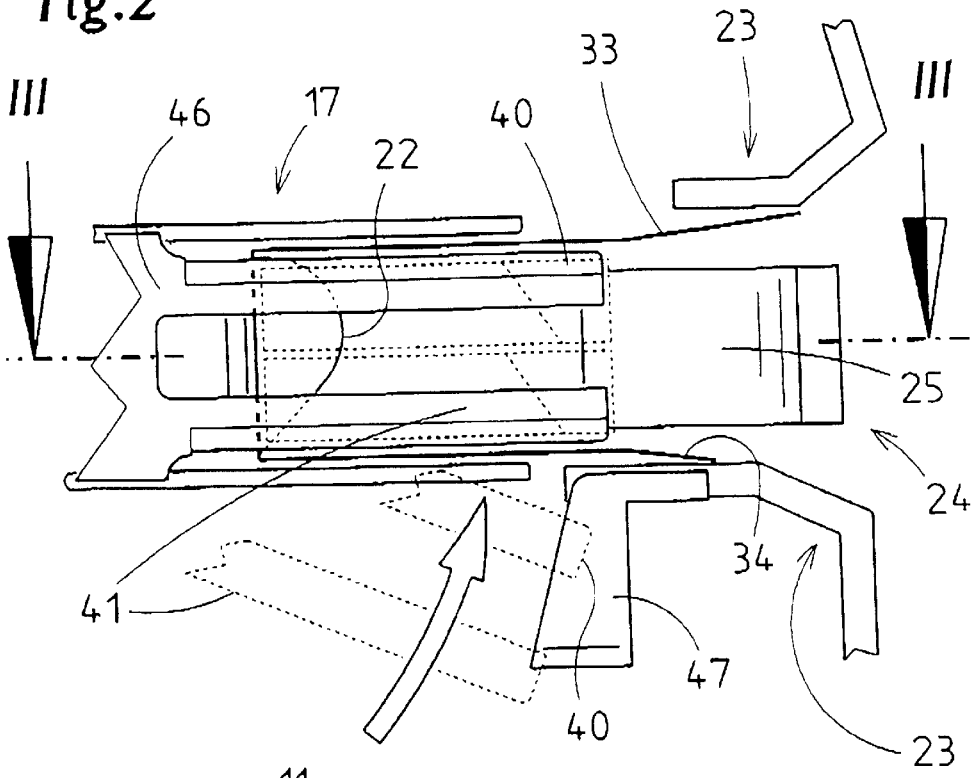
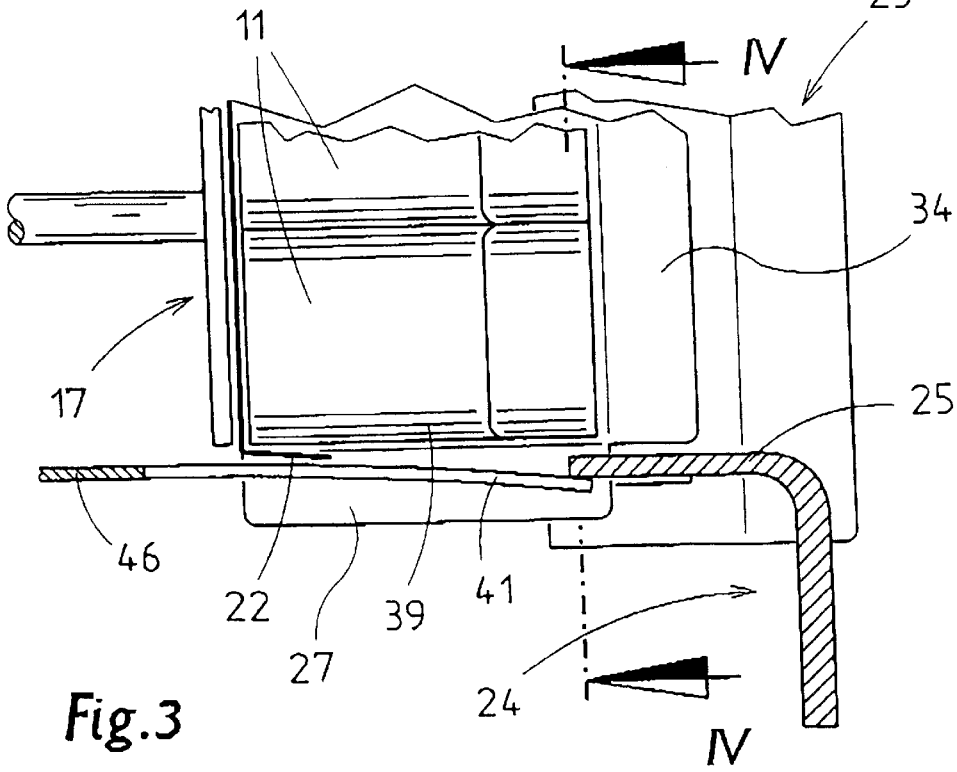
Fig.3

12
14
17
39
44
42
40
28
27
41
45
43
32
29
31
13
11
22
25
47

APPARATUS FOR PRODUCING BUNDLE PACKAGES FOR CIGARETTES

BACKGROUND OF THE INVENTION

The invention relates to an apparatus for producing cuboid-shaped (cigarette) packages having an outer wrapper which can be folded around the package's contents, in particular around a group of packs, in a receptacle—pocket—of a folding assembly—folding turret, thus forming essentially right-angled pack edges.

The outer wrappers of packages, in particular of bundle packages for cigarettes, should have precisely folded package edges, primarily with a right-angled cross section. During the production of packages whose contents are not exactly cuboid-shaped or not delimited by right-angled edges, especially in the production of bundle packages with a group of cigarette packs having rounded pack edges—round-corner packs—the formation of package edges having a right-angled cross section is problematical.

The invention is based on the problem of finding measures to ensure a precise formation of package edges independent of the contents of the package.

SUMMARY OF THE INVENTION

In, order to solve this problem, the apparatus according to the invention is characterized in that each pocket of the folding assembly has edge supports, around which the outer wrapper can be folded and which can thereafter be moved out of the supporting position.

According to the invention it follows that a blank for the outer wrapper is not—as is the usual case—folded directly around the package contents in the region of the package edges as well. Instead, according to the invention, support elements are provided in the region of the package edges which are configured and arranged such that they ensure a folding of the blank in this region which results in the formation of precisely defined package edges.

During the production of a bundle package for cigarettes, the invention provides for the edge supports to be positioned in the region of upper and lower side edges of the end walls of the bundle package. When the (finished) package is ejected from the respective pocket of the folding turret, the edge supports connected to the folding turret or its pockets are drawn out of their supporting position inside the package.

Other features of the invention relate to individual details of the folding assembly or folding turret during production, namely the folding of a blank for the outer wrapper of a bundle package.

BRIEF DESCRIPTION OF THE DRAWINGS

An exemplary embodiment of the apparatus is described below in more detail with the aid of the drawings, which show:

FIG. 3 a horizontal cut made through the pocket from FIG. 2 along section plane III—III.

DETAILED DESCRIPTION OF THE INVENTION

Figure 1:
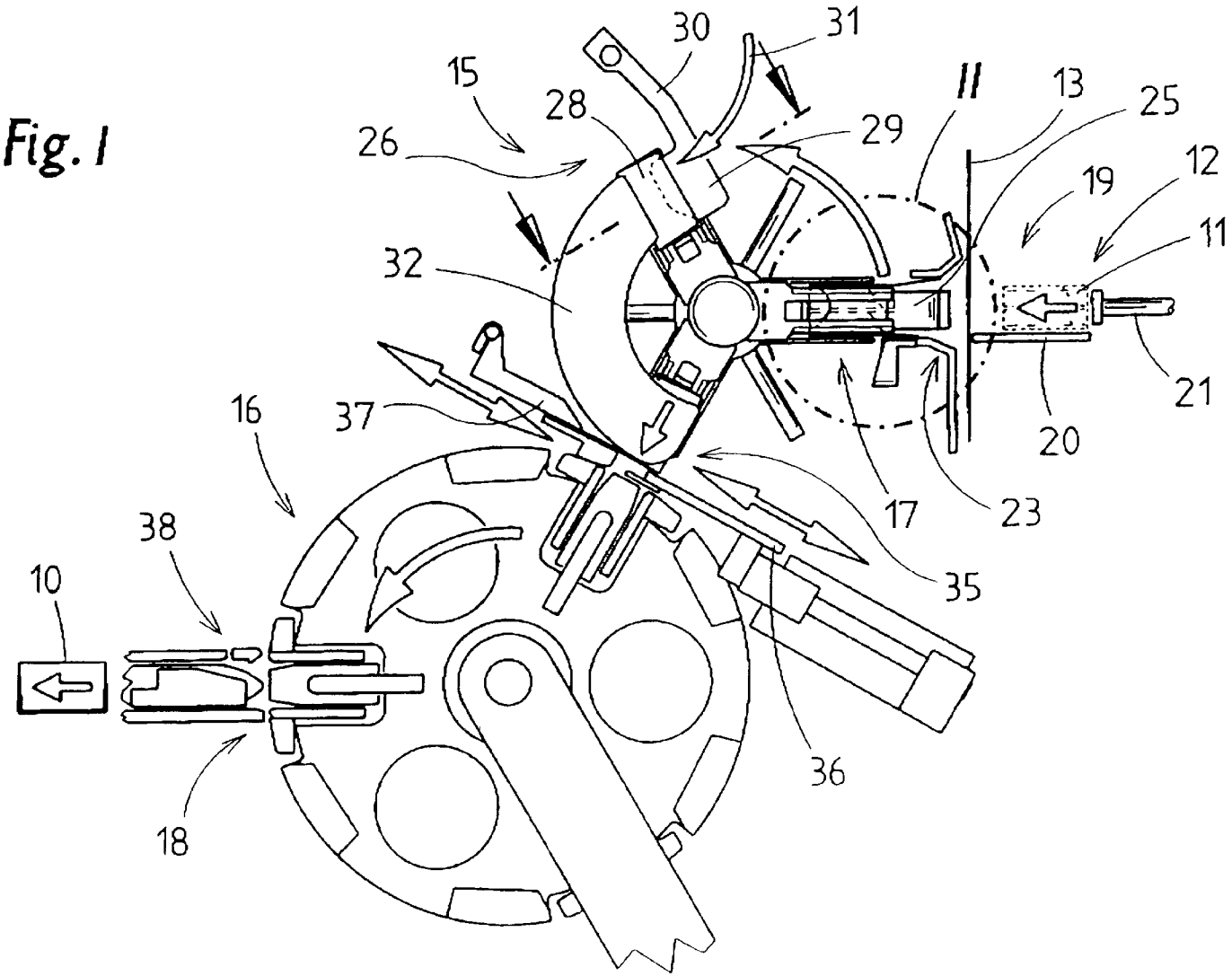
FIG. 1 an apparatus for the production of bundle packages for cigarettes, in a schematic side view, FIG. 2 a detail of the apparatus according to FIG. 1, namely a side view of a pocket, on an enlarged scale.

The exemplary embodiment in the drawings relates to the production of bundle packages 10 for cigarettes—so-called cigarette cartons. A group of cigarette packs 11, namely a pack group 12, is to be wrapped on all sides in a blank 13 made of paper, thin cardboard or the like, with the blank 13 finally forming an outer wrapper 14 of the bundle package 10.

Employed in the production of the bundle package 10 is an apparatus according to FIG. 1, which can correspond essentially to the apparatus pursuant to EP 0 174 591. Accordingly, two folding assemblies are provided, namely a first folding turret 15 and a second folding turret 16. Each of these are equipped with pockets 17, 18 for receiving pack contents, blank or bundle package 10. In the present example, each folding turret 15, 16 is provided with three radially directed pockets 17, 18 arranged along the circumference at spaced at equal angles from each other.

The production process is initiated in the region of the upper folding turret 15, which revolves about a horizontal axis. In each case, a horizontally-oriented pocket 17 is located in an insertion station 19. Held ready on a horizontal platform are the package contents, namely a group of cigarette packs 11, usually ten cigarette packs 12, which are positioned in two rows arranged one above the other. The pack group 12 so formed is pushed off the platform and into the ready pocket 17 by a slide 21. A blank 13 used to form the outer wrapper 14 is held ready transverse to the direction of insertion. The blank 13 is taken along by the pack group 12 in the usual manner and is pushed along with the latter into the pocket 17 while being folded in a U-shape. The insertion process is facilitated by a mouthpiece 23 formed from upper and lower shaped parts.

During the insertion of the pack group 12 and blank 13 into the pocket 17, corner flaps 22 lying to the front in the direction of insertion and projecting laterally beyond the pack contents are folded. Serving as the folding member for these lateral corner flaps 22 are side folders 24, which are arranged in a stationary position in the region of the insertion station 19. They are positioned as right-angled pieces at either side of the folding turret 15, specifically as a continuation of the pocket 17. When the blank 13 with the pack contents are inserted into the pocket, the corner flaps 22 are folded against the end surfaces of the pack group 12 by a leg 25 of the side folder side folder 24 extending in continuation of the pocket.

After insertion of pack group 12 and blank 13 into the pocket 17, the folding turret 15 is revolved by one stroke, thus moving the pocket 17 concerned into the region of a folding station 26. In the region of same the laterally directed folding flaps are folded, namely end flaps 27 and 28. The latter—along with the corner flap 22—form laterally directed end walls of the bundle package 10. In the process, the shorter, inside end flap 27 is brought into the folding position by a fixed-mounted, pivotable folding member, namely by a folding plate 29. The folding plate is disposed on a pivoted lever 30 and is actuated by it. The direction of the folding movement is indicated by arrow 31. The folding position is in particular illustrated in FIG. 5.

The second, outer end flap 28 is folded as the folding turret 15 continues its movement, and specifically by means of a stationary, segment-shaped outer guide 32 at either side of the folding turret 15. This discoid folding member moves the end flap 28 into the folding position (FIG. 6) by means of the relative motion of the folding turret 15 and secures both end flaps 27, 28 in this folding position. The end flaps 27, 28 are provided with glue at the appropriate point so that the end flaps 27, 218 are adhesively bonded to each other in the position according to FIG. 6.

Additional folding flaps, namely longitudinal flaps 33 and 34 projecting out of the pockets 17 on the side open in the circumferential plane, are folded in the third station of the folding turret 15, namely in the transfer station 35. Provided here in the region of a tangential plane are displaceable folders 36 and 37, which fold the initially radial longitudinal flaps 33, 34 into their closed position by moving in the plane tangential to the two folding turrets 15, 16. Afterwards, the bundle package 10, now finished in this respect, is pushed out of the turret 15 and received by a opposite pocket 18 of the folding turret 16. The latter transports the bundle package 10 to a discharge station 38.

Figures 4, 5, 6:
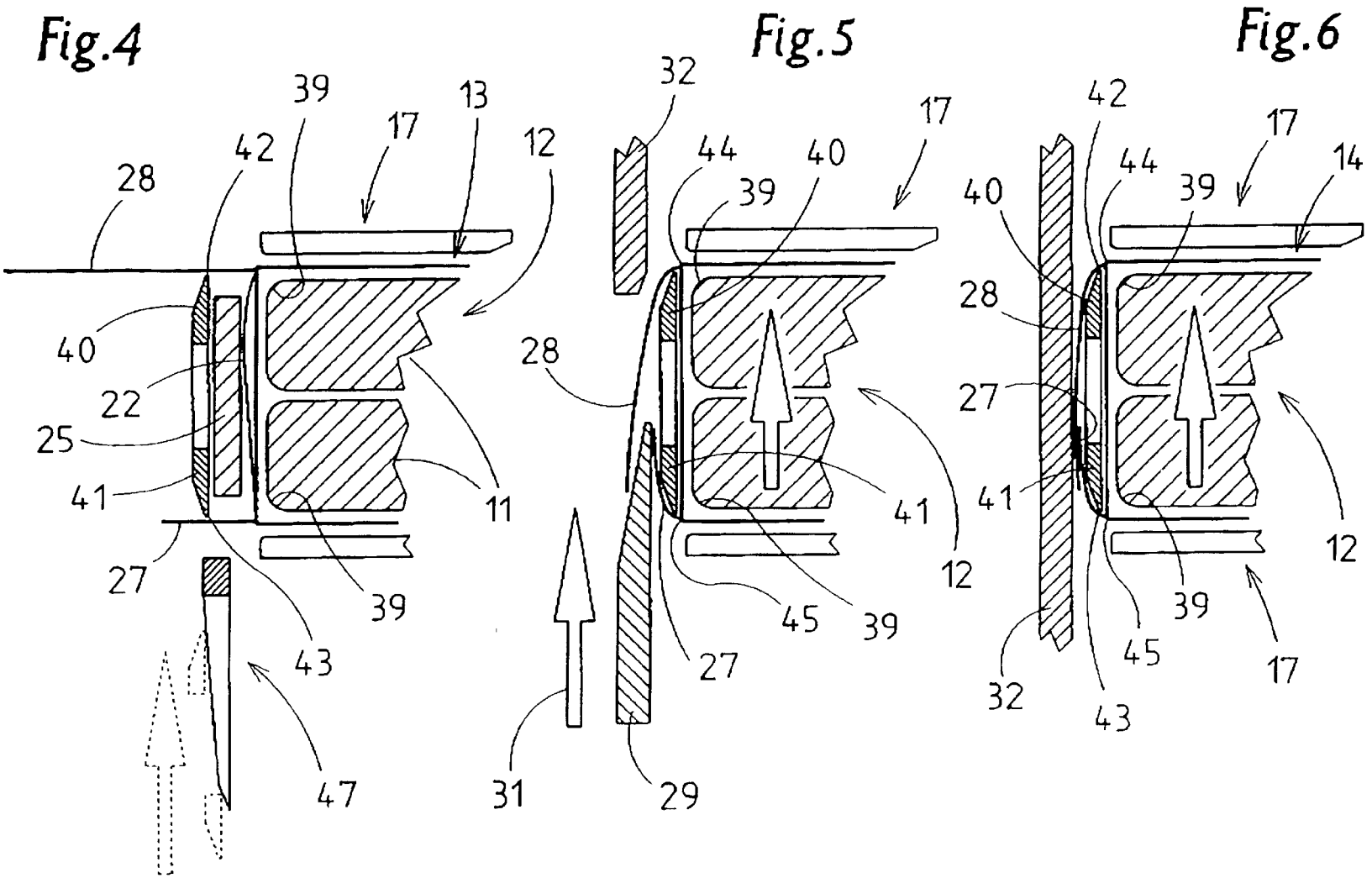
FIG. 4 a transverse cut through part of the pocket ie the sectional plane IV—IV of FIG. 3.
FIG. 5 the detail from FIG. 4 in an altered position during the production of the bundle package.
FIG. 6 the detail according to FIG. 4 and FIG. 5 after production of the bundle package before it is ejected from the pocket.

Special supporting members are provided to create a precise, in particular a right-angled cross section, in the folded edge when folding the folding tabs. In the present exemplary example, these members work during the folding of the end face folding flaps, namely end flaps 27 and 28. Above all, this takes into account that the cigarette packs 11 to be wrapped are configured as round-corner packs with upright rounded edges 39. Thus the outer cigarette packs 11 or those adjacent to the end wall cannot serve as an inside support to give the proper shape to the end flaps 27, 28 when they are folded. Each pocket 17 is provided with edge supports 40, 41 as a folding aid member. Said edge supports 40, 41 are thin-walled, elongate members with sharp (upper and lower) folding edges 42, 43. These adjacent outer surfaces of the edge supports 40, 41 are scarfed, i.e. tapered to a sharp edge. In conformance with the design of the lateral end walls, two edge supports 40, 41 are provided to give shape to an upper and lower package edge 44, 45. To do so, the edge supports 40, 41 are positioned such that the folding flaps, namely end flaps 27, 28 are folded around the folding edges 42, 43. After this folding procedure, the end flaps 27, 28 are located on the outer side of the edge supports 40, 41 (FIG. 6).

In the present exemplary embodiment, the thin-walled edge supports 40, 41 form a lateral boundary of the pockets 17. In a region lying at a distance from the entry side, the web-shaped edge supports 40, 41 are connected to one another by a transverse web 46. Together with this transverse web 46, the edge supports 40, 41 accordingly form a fork-shaped, lateral boundary of the pockets 17.

Another special feature is that the elastically ductile edge supports 40, 41 in the insertion station are brought into an open, funnel-shaped position (FIG. 3). This facilitates the insertion of the pack group 12 along with the blank 13. In the process, a side folder 24 or its leg pointing toward the pocket 17 serve as a supporting member, against which the free end region of the edge supports 40, 41 abut in this station (FIG. 3).

In order to move the edge supports 40, 41 into this opening position or to abut against the side folders 24, a shaped piece 47 is arranged before the insertion station 19 as seen in the rotational direction of the folding turret 15. Before entering the insertion station 19, the corresponding end regions of the edge supports 40, 41 lead into the shaped piece 47 of wedge-shaped configuration. The latter is positioned below the insertion station 19 for this purpose. (FIG. 2). Due to this leading movement, the edge supports 40, 41 are shaped toward the outside, maintaining this position by subsequent abutment on the leg 25. When the pocket 17 leaves the insertion station 19, the edge supports 40, 41 return to their normal position after withdrawing from the leg 25 (FIG. 5. FIG. 6). In this position they can fulfill their function in the region of the following folding station 26.

The edge supports 40, 41 are accordingly brought into position already in the insertion station 19 and remain in this position until the transfer station 35. As the bundle package 10 is pushed out of the pocket, the edge supports 40, 41 are also retracted from their supporting position or out of the bundle package 10 so that the latter is free of edge supports and is transferred into the folding turret 16 with correctly folded package edges 44, 45.

Other folding flaps may also be folded with the aid of folding supports with the corresponding package design.

List of Designations

10 bundle package
11 cigarette pack
12 pack group
13 blank
14 outer wrapper
15 folding turret
16 folding turret
17 pocket
18 pocket
19 insertion station
20 platform
21 slide
22 corner flaps
23 mouthpiece
24 side folder
25 leg
26 folding station
27 end flaps
28 end flaps
29 folding plate
30 pivoted lever
31 arrow
32 outer guide
33 longitudinal flaps
34 longitudinal flaps
35 transfer station
36 folder
37 folder
38 discharge station
39 rounded edge
40 edge support
41 edge support
42 folding edge
43 folding edge
44 package edge
45 package edge
46 transverse web
47 shaped piece

What is claimed is:

1. An apparatus for producing cuboid-shaped packages each having an outer wrapper which is adapted to be folded around contents of the package in a pocket (17) of a folding assembly (15), thus forming essentially right angled package edges (44, 45), characterized in, that at least during folding of folding flaps (27, 28) which form the package edges (44, 45), folding aids are arranged in a region of the package edges (44, 45) to be produced, said folding aids comprising edge supports (40, 41) around which the folding flaps (27, 28) are folded, and that said pocket (17, 18) is assigned said edge supports (40, 41), said apparatus comprising means for, after the folding of the folding flaps (27, 28), retracting the edge supports (40, 41) from a supporting position by ejecting or pushing the package (10) out of the pocket (17).

2. The apparatus according to claim 1, characterized in that, during the producing of the packages (10), the edge supports (40, 41) are arranged in a region of laterally directed end walls of the package (10), namely for the purpose of giving shape to the package edges (44, 45) when the folding flaps (27, 28) are folded.

3. An apparatus for producing cuboid-shaped packages each having an outer wrapper which is adapted to be folded around contents of the package in a pocket (17) of a folding assembly (15), thus forming essentially right angled package edges (44, 45), characterized in, that at least during folding of folding flaps (27, 28) which form the package edges (44, 45), folding aids are arranged in a region of the package edges (44, 45) to be produced, said folding aids comprising edge supports (40, 41) around which the folding flaps (27, 28) are folded, and that the edge supports (40, 41) are part of the pocket (17), and form a boundary of the pocket (17), with the edge supports (40, 41) extending to a region of the package edges (44, 45) to be produced.

4. An apparatus for producing cuboid-shaped packages each having an outer wrapper which is adapted to be folded around contents of the package in a pocket (17) of a folding assembly (15), thus forming essentially right angled package edges (44, 45), characterized in, that at least during folding of folding flaps (27, 28) which form the package edges (44, 45), folding aids are arranged in a region of the package edges (44, 45) to be produced, said folding aids comprising edge supports (40, 41) around which the folding flaps (27, 28) are folded, and that said edge supports are two web-shaped edge supports (40, 41) that are arranged at a distance from each other and are connected to each other by a transverse web (46) to form a fork-shaped unit with folding edges (42, 43) which are directed outwardly or upwards and downwards, and which are formed by scarfing of the edge supports (40, 41).

5. An apparatus for producing cuboid-shaped packages each having an outer wrapper which is adapted to be folded around contents of the package in a pocket (17) of a folding assembly (15), thus forming essentially right angled package edges (44, 45), characterized in, that at least during folding of folding flaps (27, 28) which form the package edges (44, 45), folding aids are arranged in a region of the package edges (44, 45) to be produced, said folding aids comprising edge supports (40, 41) around which the folding flaps (27, 28) are folded, and that the edge supports (40, 41) are arranged at the pocket (17) in a displaceable or elastically ductile manner, and that in a region of an insertion station (19) for the package contents, the edge supports (40, 41) are adapted to be moved into an funnel-shaped opening position diverging at an insertion side of the pocket (17).

6. The apparatus according to claim 5, characterized in that the edge supports (40, 41) are deformed, during movement of the pocket (17) into the insertion station (19), by leading free ends of the edge supports (40, 41) onto a stop (24).

7. The apparatus according to claim 6, characterized in that located upstream of the stop (24) in a conveying direction of the pocket (17) is a deformation member (47) which, as a result of the conveying direction of the pocket (17), produces an elastic deformation of the edge supports (40, 41).

8. An apparatus for producing cuboid-shaped packages each having an outer wrapper which is adapted to be folded around contents of the package in a pocket (17) of a folding assembly (15), thus forming essentially right angled package edges (44, 45), characterized in, that at least during folding of folding flaps (27, 28) which form the package edges (44, 45), folding aids are arranged in a region of the package edges (44, 45) to be produced, said folding aids comprising edge supports (40, 41) around which the folding flaps (27, 28) are folded, and that the apparatus comprises means for pushing a finished package (10) away from the edge supports (40, 41) by pushing the package out of the pocket (17).

* * * * *